US006425424B1

(12) United States Patent
Ellis Calvo et al.

(10) Patent No.: US 6,425,424 B1
(45) Date of Patent: Jul. 30, 2002

(54) MULTI USE FUNNELS

(76) Inventors: Janet H. Ellis Calvo; Rafael A. Calvo, both of 145 Hurlbut St., Pasadena, CA (US) 91105

( * ) Notice: Subject to any disclaimer, the term of this patent is extended or adjusted under 35 U.S.C. 154(b) by 0 days.

(21) Appl. No.: 09/154,938

(22) Filed: Sep. 17, 1998

Related U.S. Application Data

(60) Provisional application No. 60/033,792, filed on Dec. 30, 1996.

(30) Foreign Application Priority Data

Dec. 23, 1997 (WO) ..... PCT/US97/24164

(51) Int. Cl.[7] ..... B67C 11/00
(52) U.S. Cl. ..... 141/331; 141/340; 141/384
(58) Field of Search ..... 141/331, 340–342, 141/384

(56) References Cited

U.S. PATENT DOCUMENTS

| | | | | | |
|---|---|---|---|---|---|
| 100,851 | A | * | 3/1870 | Brundage et al. | 141/340 |
| 589,659 | A | * | 9/1897 | Krack | 141/331 |
| 630,965 | A | * | 8/1899 | Wurster | 141/340 |
| 641,267 | A | * | 1/1900 | Cahill | 141/340 |
| 2,546,040 | A | * | 3/1951 | Murray | 141/341 |
| 5,195,567 | A | * | 3/1993 | Tyree, Jr. | 141/331 |
| 5,472,025 | A | * | 12/1995 | Conrad et al. | 141/331 |
| 5,479,970 | A | * | 1/1996 | Trani | 141/384 |
| 5,762,120 | A | * | 6/1998 | Smith | 141/340 |
| 5,921,296 | A | * | 7/1999 | Porter et al. | 141/340 |

FOREIGN PATENT DOCUMENTS

| | | | | |
|---|---|---|---|---|
| GB | 204746 | * | 10/1923 | 141/340 |
| GB | 280504 | * | 4/1928 | 141/340 |
| SE | 121519 | * | 4/1948 | 141/331 |

* cited by examiner

*Primary Examiner*—J. Casimer Jacyna
(74) *Attorney, Agent, or Firm*—John E. Wagner; Sam Bernardo

(57) ABSTRACT

A series of multi use funnels are designed to attach by threads or pressure fit to a variety of threaded or non threaded fill openings of bottles or containers. Two or more concentric female threaded or friction engaging connectors are located at the discharge opening of the funnel. The innermost connector is the smaller or smallest and each size is graduated outward therefrom. A secondary funnel is located inside of the innermost female threaded connector to direct fluid into the attached container below the junction of the top of the bottle of container and the first threads. A sealing annular ring or step is located at each connector portion. Single diameter versions are shown as well as slip-on versions for use with threaded, snap-on or straight sided bottle filling openings.

2 Claims, 4 Drawing Sheets

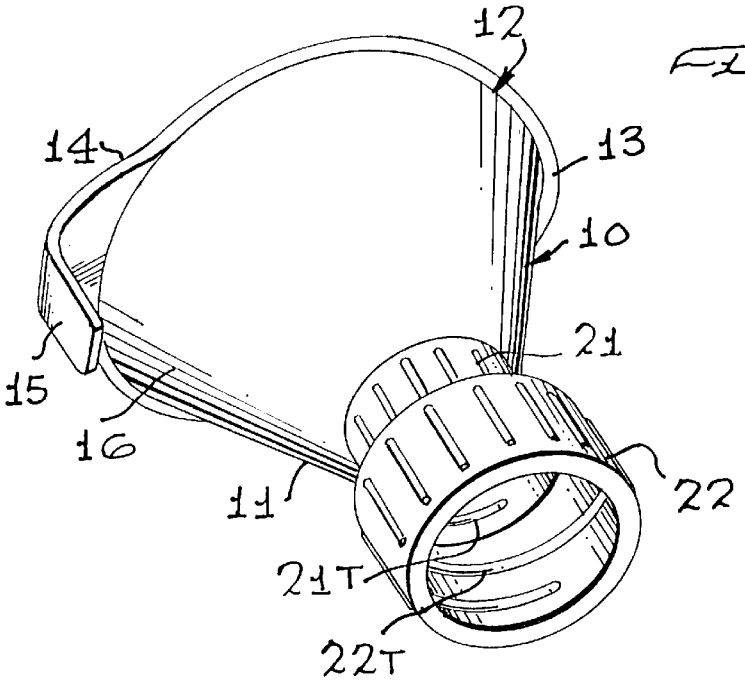
FIG. 1
FIG. 2
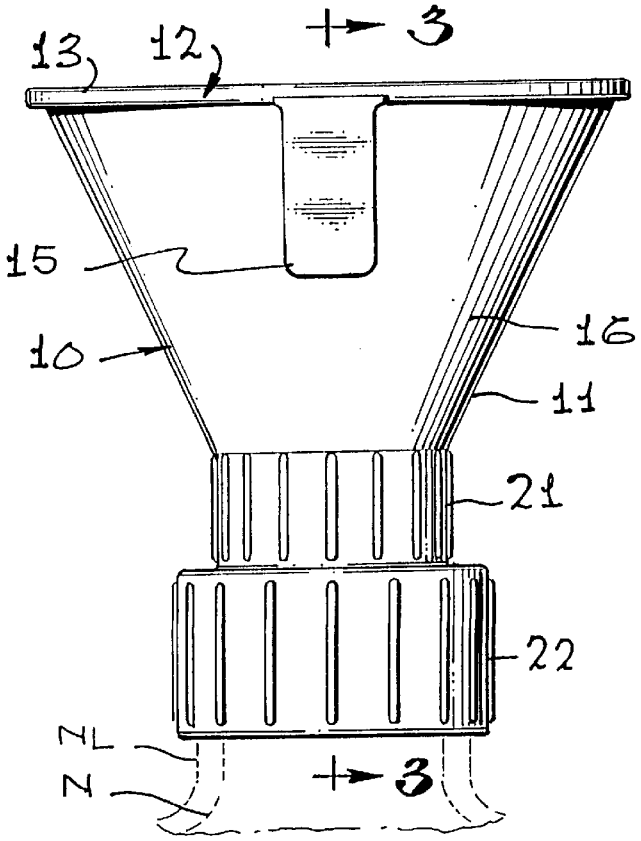

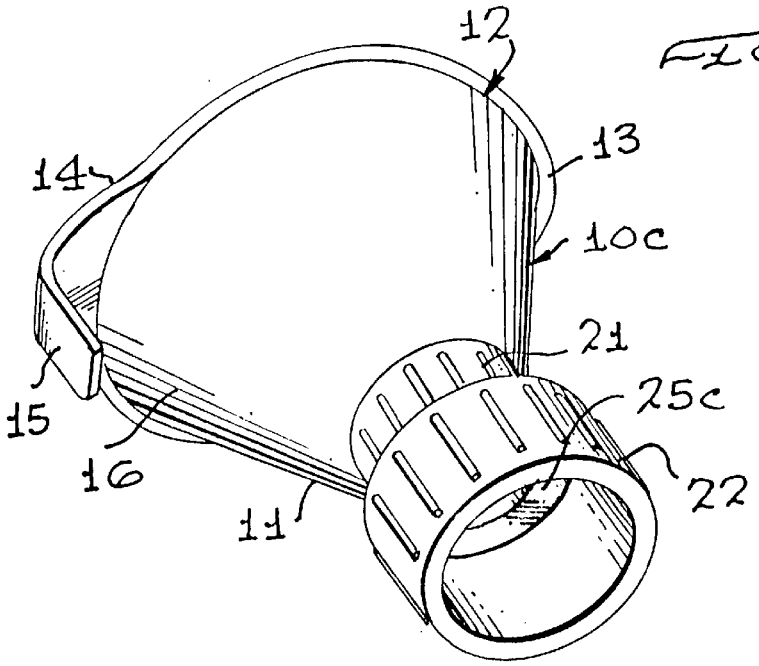
FIG. 6
FIG. 7
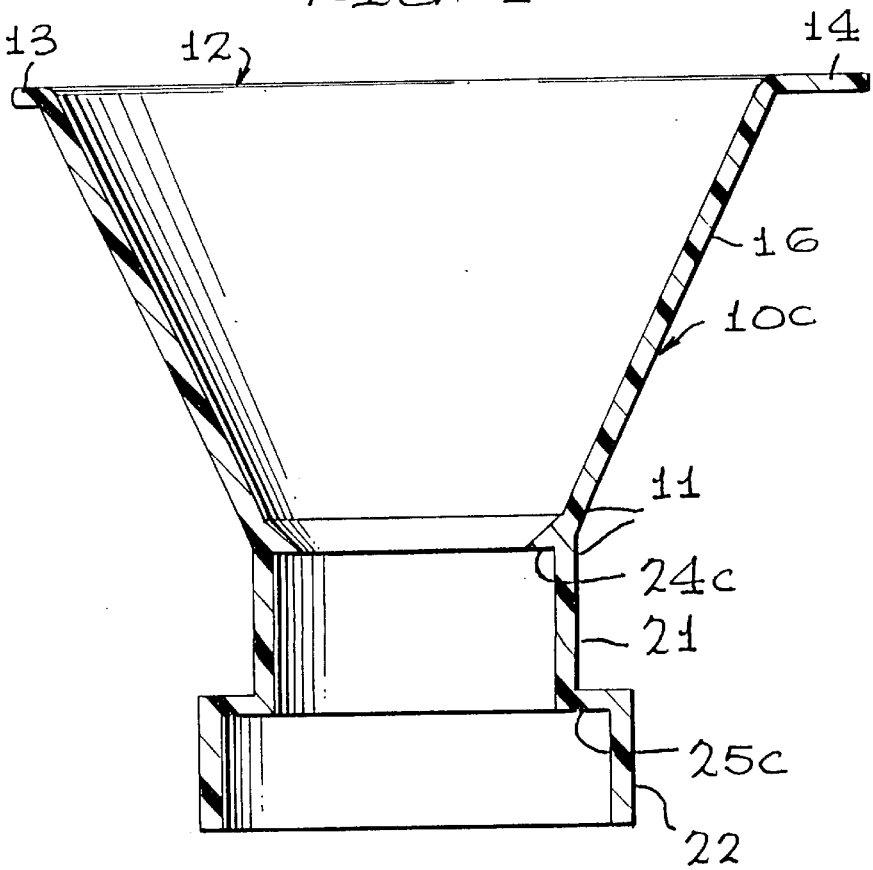

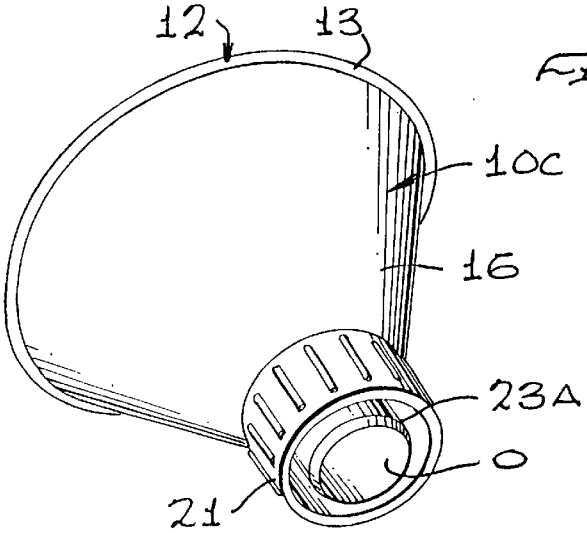
FIG. 8
FIG. 10
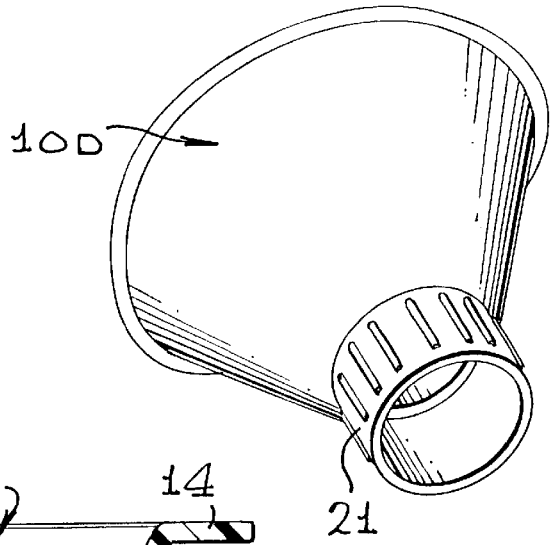
FIG. 9
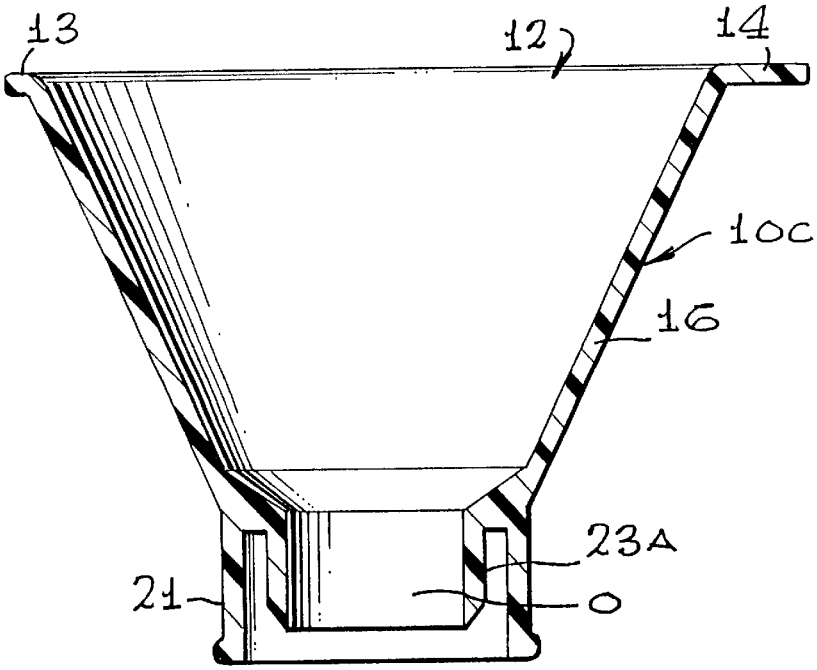

MULTI USE FUNNELS

REFERENCE TO RELATED APPLICATIONS

This application claims priority to PCT/US97/24164 filed on Dec. 23, 1997 which is based upon provisional application serial No. 60/033,792 filed Dec. 30, 1996.

BACKGROUND OF THE INVENTION

For centuries, the filling of containers having a narrow neck and a closure has been aided by the use of a funnel which is inserted in the opening of the container. Typically, the funnel is loose fitting, may fall out of the container and allow leakage around the lip of the container opening. In some cases pouring into the funnel at an angle can tip the funnel and actually tip the container. If the container is over filled using a conventional funnel, spillage is guaranteed. Spillage in any case is undesirable and in the case of dangerous or corrosive materials, a critical situation results.

In certain specialized applications, funnels have been developed which have a screw-on bottom for use with threaded containers.

We have noted that in the case of bottled potable water, many persons desire to carry bottles with them to provide sanitary water at any time. Commonly, 0.5, 1.0, 1.5 and 2.0 liter bottles are favored because they usually provide sufficient water for an individual and are easily transported.

Unfortunately, the smaller bottles of the 0.5, 1.0 and 1.5 liter size and even those of the 2.0 liter size, when potable drinking water is purchased, are quite expensive compared with the typical five-gallon bottle. In certain cases, one may want to fill one of the smaller bottles from the larger container without spillage and then replace a screw-on or dispenser cap. The same is true if a bottle is filled from another water source.

BRIEF DESCRIPTION OF THE INVENTION

With this state of the art in mind, we devised a screw-on, a snap-on funnel and a pressure fit funnel which are capable of reliable use on at least five different sizes and various fill opening styles of bottles. We have also developed designs which are subject to manufacture either by blow molding or by injection molding. We have also developed variations of our funnel in which there is positive sealing of the fluid from the exterior of the bottle or container during filling so that no liquid can leak out over the bottle engaging portions.

Basically, our funnel includes a tapered receiver portion which preferably is in the 2 to 4 inch diameter in size narrowing down to a smaller fluid delivery throat. At the throat of the funnel there are two sets of internal threads with the inner set of threads corresponding to the smaller size container, e.g., 0.5 to 2.0 liter size, and the larger thread adapted to fill larger fill opening bottles, e.g., 1.0 liter or one gallon bottles. In using the funnel with a smaller bottle, the outer threaded portion acts as a guide in directing the funnel over the neck of the smaller bottle. This is helpful since the threaded inner portion is not directly visible while the smaller bottle is to be filled.

Certain types of bottles include snap-on lids without threaded connections. We have found that our specialized funnels can serve the needs to carefully fill such bottles, as well. This is accomplished in two ways. First, our threaded discharge openings will engage bottle or other container openings which have an outside diameter which approximates the peaks of the internal threads. Secondly, a relatively straight sided non threaded discharge opening will engage and apply force or pressure against the exterior of the container neck sufficient to hold the funnel securely on the container. Those may be either single or multiple stage snap-on funnels.

In another embodiment, the funnel is not threaded but is slightly resilient and the resiliency provides engagement with the threads or the exterior of the bottle neck.

In additional embodiments, the throat of the funnel includes a downward extending secondary funnel which extends into the full opening of a bottle to be filled and therefore aligns a sealing lip as well as directing all fluids well below the opening of the neck of the bottle being filled. The secondary funnel is short enough that it does not extend below the bottle neck.

Another factor in the design and production of funnels is the method by which the funnel is manufactured. A form of manufacturing which produces good quality products and at relatively low cost is blow molding which is used often for the production of bottles. It is significantly less expensive than injection molding which allows for more precise shapes but encounters substantial tooling costs.

We have found that it is possible to make adequate threads to engage the bottle top employing blow molding of our design. Therefore, the blow mold version of this invention is preferred. On the other hand, where we need precise fitting or the secondary funnel, the injection mold version is the preferred option.

In the case of the blow molded version of this invention, either the larger or smaller discharge portion may be used or a double threaded discharge portion can be present. In the blow molded version, the secondary funnel is not compatible with the blow molded technique so it is reduced to a smaller protruding lip.

In the non threaded embodiments either blow molding or injection molding may be used.

BRIEF DESCRIPTION OF THE DRAWING

This invention may be more clearly understood with the following detailed description and by reference to the drawings in which:

FIG. 1 is a perspective view of one embodiment of this invention;

FIG. 2 is a side elevational view of the embodiment of FIG. 1;

FIG. 6 is a perspective view of a funnel embodiment designed for non threaded engagement with the necks of two sizes of bottles;

FIG. 7 is a diametrical sectional view of the embodiment type shown in FIG. 6;

FIG. 8 is a perspective view of a single size neck opening funnel with leakage protection;

FIG. 9 is a diametrical sectional view of a slip fit engagement embodiment of FIG. 8 designed for use with one size of either threaded or non threaded bottle opening; and FIG. 10 is a perspective view of a single neck opening funnel designed particularly for blow molding production.

DETAILED DESCRIPTION OF THE INVENTION

Figure 3:
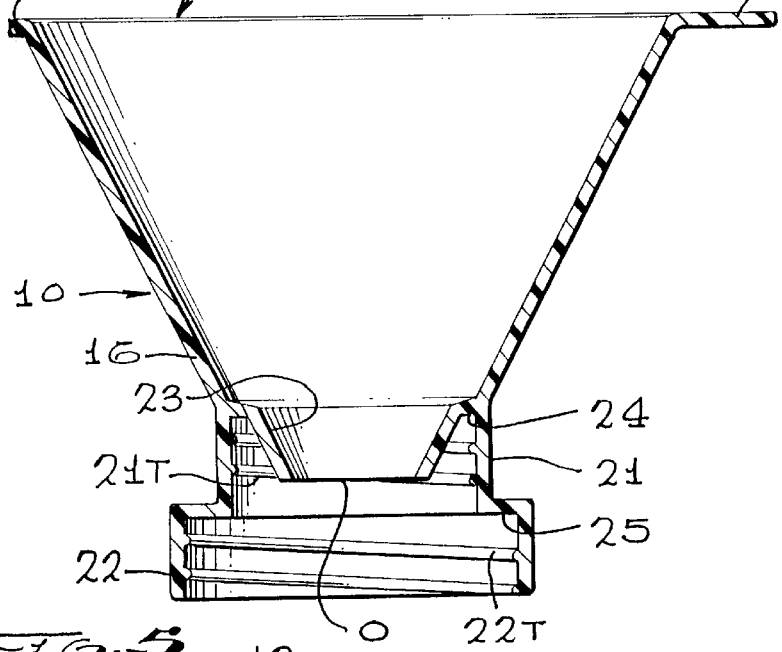
FIG. 3 is a diametrical sectional view of the embodiment of FIGS. 1 and 2 taken along line 3—3 of FIG. 2.
Figure 5:
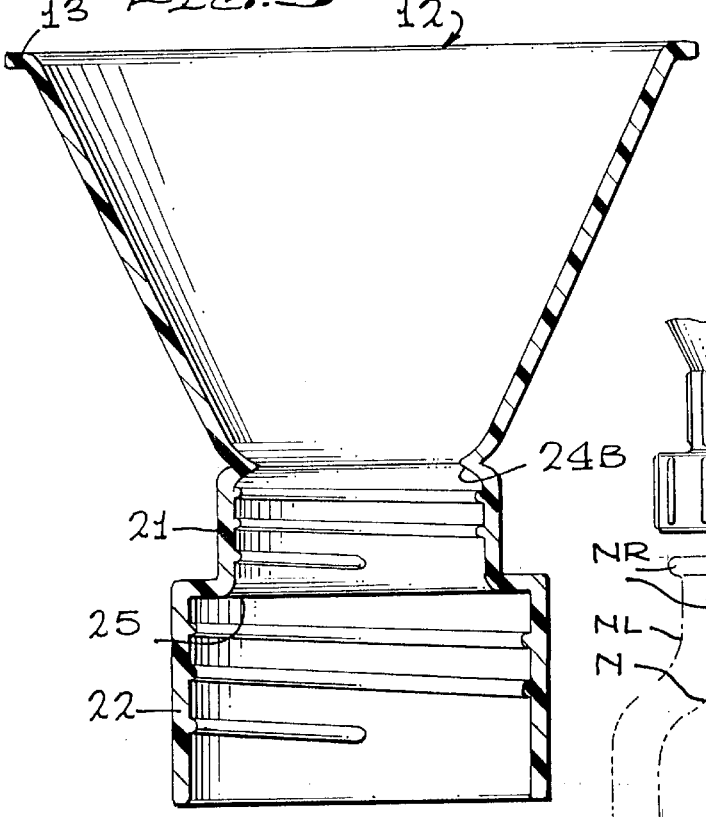
FIG. 5 is a diametrical sectional view of an alternate embodiment of this invention designed particularly for blow molding production.

Now referring to the drawing FIGS. 1–3, a funnel of this invention may be seen ready for installation on the fill opening of a conventional 0.5 to 2.0 liter or larger water container having either a 28 or 38 mm OD (outside dimension) filling opening. The funnel, generally designated 10, is a unitary plastic form of such material as polyvinyl chloride or the like which may be formed either by injection molding or blow molding. The version of FIGS. 1–3 comprises a body portion 11 with its fill opening unshown but designated 12 at its upper rim 13. A handle 14 is shown integrally molded as a part of the funnel 10 at one side of the rim 13 and actually as a side extension of the rim. The handle 14 includes a depending tab 15 which may be used for holding with one or two fingers located below the handle 14 to provide a secure grasp when filling the bottle, unshown in FIG. 1 and except for its neck regions N and NL for larger bottles, shown in phantom, in FIG. 2.

The funnel 10 includes a tapered portion 16 as is conventional with a conventional discharge opening O, best seen in FIG. 3 at the bottom of the conical tapered portion 16. A small portion of the discharge opening O appears in FIG. 1 as line 20. Significant in this invention is the fact that the discharge opening includes at least one threaded or bottle engaging portions such as 21 and 22. In the threaded embodiment of FIGS. 1–3 and 5, both threaded portions have ribs on the outer surface to aid in threading the funnel on the neck of a bottle to be filled.

The two threaded discharge portions 21 and 22 of FIGS. 1 and 3 are coaxial with the larger portion 22 below the portion 21 so that the larger portion additionally acts as a guide for the funnel when being placed over the neck and receiving opening of a first size, e.g., a 0.5 thru 2.0 liter bottle. When used with a larger size bottle, the lower portion 22 engages the threads of the larger bottle, e.g., one having a 38 mm or thereabouts fill opening, in the same manner as a removable cap.

One additional feature of this embodiment is seen in FIG. 3. It is that a secondary funnel 23 is present which defines the discharge opening O of the funnel 10. This secondary funnel 23 is slightly smaller than the conical portion of the funnel 10 and includes an annular recess with a sealing rim 24 at the upper end of the threads 21T of the portion 21. This secondary funnel 23 not only prevents leakage around the threads but also directs flow into the bottle.

Figure 4:
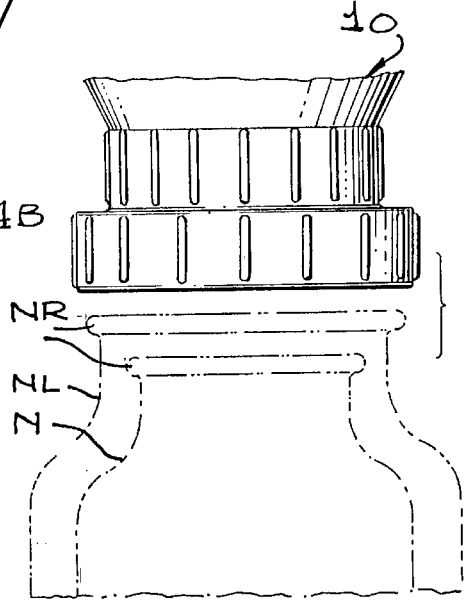
FIG. 4 is an enlarged fragmentary side elevational view of the embodiment of FIGS. 1–3 showing particularly the bottle attachment lower end of the funnel of this invention.

A second set of threads 22T is located within the lower section 22 with its own sealing stop 25. The section 22 has a length which is sufficient to provide at least two threads engagement with a larger size container but does not interfere with a smaller bottle's neck expansion as is illustrated in FIG. 4 where a smaller bottle neck N is indicated by dash-dot lines and a larger bottle neck NL is indicated by dash-dot-dot lines. Also, in the case of bottles having snap-on neck rings NR below the threads of the fill opening, the section 22 is of sufficient diameter to accommodate such neck rings as is illustrated in FIG. 4.

As indicated above, in the interest of economy in tooling, the production of our funnels, similar to many of the bottles with which they will be used, may be produced employing blow molding processes as are well known in the plastic molding art and described in the Modern Plastics Encyclopedia, McGraw Hill Companies, Inc., 1996 Edition, Section D-3.

For blow molding production, the designs of FIGS. 5–10 are preferred. Now referring to FIG. 5 in which the same numerals are used for identical parts as in the previous figures, the funnel 10B includes a fill opening 12, a rim 13, a tapered or conical portion 16, a first or upper threaded section 21, and a lower or larger or lower threaded section 22. The embodiment of FIGS. 5 and 6 includes a stop 24B and stop 25 but no handle or secondary funnel 23 owing to the process of blow molding. Functionally both the embodiments of FIGS. 1–4 and FIGS. 5 and 7 are suitable for this multi size bottle use.

FIG. 6 illustrates a two size slip-on funnel 10C which is basically identical to FIG. 1 except for the lack of threads in the discharge portions 21 and 22. The inside diameters match the fill opening outside diameters of containers for intended use, e.g., 28 mm for section 21 and 38 mm for section 22. The material of the funnel is a plastic having sufficient resiliency to expand slightly while slipping over the neck of the container and engage it sufficiently to allow filling without tipping or leakage.

FIG. 7 shows that the embodiment of FIG. 6 includes two stops 24C and 25C which also act as seals when the funnel is attached.

A single size container funnel 10C with a straight sized secondary funnel 23A is shown in FIGS. 8 and 9. This version is designed to provide an even and more positive connection and seal with a bottle or other container with sealing, as well. The inner surface of section 21 as well as the outer surface of secondary funnel 23A engage the outer and inner surfaces of the fill opening of the neck bottle. In this case bottles as shown in FIG. 4 in dash-dot lines with a snap-on neck rim NS may be filled but threaded bottle fill openings also will be engaged by the funnel 10C.

One more embodiment of the invention is illustrated in FIG. 10. It is a single size, slip-on attachment funnel 10D with a single discharge portion 21. This version is identical for blow molding production.

Employing this invention, the user may acquire a single funnel and find it fully functional for at least two size or two fill opening type bottles to conveniently fill them without danger of leakage around the neck during the filling process.

The above described embodiments of the present invention are merely descriptive of its principles and are not to be considered limiting.

We claim:

1. A funnel for transferring fluid to a container having a circular fill opening therein and means for securing a cap on said fill opening comprising:

a unitary plastic body having a tapered portion with an enlarged fill opening and a constricted throat;

a container engaging portion adjacent to said throat, said container engaging portion including an integral sealing rim for sealing with a container in the region of its fill opening and dimensioned and configured to engage and seal the funnel at a container fill opening;

said funnel including a plurality of concentric container engaging portions whereby said funnel may be attached to a plurality of different size fill opening containers; and including a secondary funnel communicating with said throat and extending beyond said throat within the engaging portion to direct fluid into the fill opening of a container to which the funnel is attached and spaced from the engaging portion of the funnel.

2. A funnel for transferring fluid to a container having a circular fill opening therein and means for securing a cap on said fill opening comprising:

a unitary plastic body having a tapered portion with an enlarged fill opening and a constricted throat;

a container engaging portion adjacent to said throat, said container engaging portion including an integral sealing rim for sealing with a container in the region of its fill opening and dimensioned and configured to engage and seal the funnel at a container fill opening;

said funnel including a plurality of concentric container engaging portions whereby said funnel may be attached to a plurality of different size fill opening containers; and including a secondary funnel communicating with said throat and extending beyond said throat within the engaging portion to direct fluid into the fill opening of a container to which the funnel is attached and spaced from the engaging portion of the funnel;

wherein said secondary funnel and said engaging portion define an integral sealing rim.

* * * * *